US006925929B2

(12) United States Patent
Dionne

(10) Patent No.: US 6,925,929 B2
(45) Date of Patent: Aug. 9, 2005

(54) SCREW PRESS

(75) Inventor: Hugues Dionne, Montreal (CA)

(73) Assignee: Advanced Fiber Technologies (AFT) Trust, Lennoxville (CA)

( * ) Notice: Subject to any disclaimer, the term of this patent is extended or adjusted under 35 U.S.C. 154(b) by 0 days.

(21) Appl. No.: 10/824,995

(22) Filed: Apr. 14, 2004

(65) Prior Publication Data

US 2004/0194646 A1 Oct. 7, 2004

Related U.S. Application Data

(63) Continuation of application No. 09/758,380, filed on Jan. 10, 2001, now Pat. No. 6,736,054.

(30) Foreign Application Priority Data

Feb. 8, 2000 (CA) ..... 2298235

(51) Int. Cl.[7] ..... B30B 9/12
(52) U.S. Cl. ..... 100/110; 100/112; 100/117
(58) Field of Search ..... 100/110, 112, 100/117, 126, 127, 145

(56) References Cited

U.S. PATENT DOCUMENTS

| | | | | |
|---|---|---|---|---|
| 3,688,687 | A | 9/1972 | Craig et al. | 100/117 |
| 4,117,776 | A | 10/1978 | Hunt | 100/117 |
| 4,266,473 | A | 5/1981 | Hunt et al. | 100/117 |
| 4,279,197 | A | 7/1981 | Hunt et al. | 100/117 |
| 4,363,264 | A | 12/1982 | Lang et al. | 99/510 |
| 4,397,230 | A | 8/1983 | Hunt et al. | 100/45 |
| 4,644,861 | A | 2/1987 | Mansfield | 100/117 |
| 4,709,628 | A | 12/1987 | Glowacki | 100/117 |
| 4,781,823 | A | 11/1988 | Shinozaki | 210/86 |
| 5,009,795 | A | 4/1991 | Eichler | 210/744 |
| 5,476,550 | A | 12/1995 | Walker | 127/2 |
| 5,516,427 | A | 5/1996 | Yoshikawa | 100/117 |
| 5,567,463 | A | 10/1996 | Schaaf | 366/87 |
| 5,653,879 | A | 8/1997 | Schroeder | 210/298 |
| 5,732,618 | A | 3/1998 | Buehl | 100/45 |
| 5,857,406 | A | 1/1999 | Scheucher et al. | 100/117 |
| 5,865,997 | A | 2/1999 | Isaacs | 210/232 |
| 6,139,685 | A | 10/2000 | Saito | 162/55 |
| 6,588,331 | B2 | 7/2003 | Thibodeau | 100/112 |

FOREIGN PATENT DOCUMENTS

| | | |
|---|---|---|
| DE | 412694 | 4/1925 |
| DE | 43543 | 12/1987 |
| JP | 07204895 | 8/1995 |
| JP | 2000000695 | 7/2000 |

*Primary Examiner*—Derris H. Banks
*Assistant Examiner*—Jimmy Nguyen
(74) *Attorney, Agent, or Firm*—Wells St. John P.S.

(57) ABSTRACT

A screw press provided with a rear excess fluid outlet is described herein. The rear excess fluid outlet includes a circular screen provided at a longitudinal end of the screw press body, near a material inlet. Scraper blade assemblies are provided to prevent the screen from clogging. The efficiency of excess fluid removal is thereby increased by the increased screen surface near the material inlet of the screw press.

5 Claims, 4 Drawing Sheets

SCREW PRESS

CROSS REFERENCE TO RELATED APPLICATION

This is a continuation of U.S. patent application Ser. No. 09/758,380, now U.S. Pat. No. 6,736,054, which was filed on Jan. 10, 2001, by Hugues Dionne, titled "Screw Press", which in turn claimed priority from Canadian Patent Application No. 2,298,235, filed Feb. 8, 2000.

FIELD OF THE INVENTION

The present invention relates to screw presses. More specifically, the present invention is concerned with a screw press provided with a rear excess fluid outlet.

BACKGROUND OF THE INVENTION

Screw presses are well known in the art. They are conventionally used for removing soluble and dispersible materials from products, for example, excess fluid from paper pulp. It is to be noted that, for concision purposes, the example of the paper pulp will be used throughout the present disclosure. This should not be construed as a limitation of the present invention.

The principle of operation of conventional screw presses is believed to be well known to those skilled in the art and will therefore only be briefly described herein.

A screw press is basically an endless screw provided with a conical shaft that compresses the pulp as it moves from an inlet to an outlet. The endless screw is enclosed in a body that is provided with a screened surface allowing the excess fluid to be expelled from the pulp.

The throughoutput of screw presses is usually controlled by the rotational speed of the endless screw. However, there are limits to this control since the rotational speed of the endless screw must be sufficiently slow to thereby allow the excess fluid to flow through the screened body. This is a drawback of the conventional screw presses since it lowers the efficiency of the unit by unduly limiting the top rotational speed of the endless screw.

SUMMARY OF THE INVENTION

More specifically, in accordance with the present invention, there is provided a screw press for removing excess fluid from material comprising a generally tubular body having a meshed surface; said body having a material inlet provided near a proximate end thereof; an endless screw mounted in said tubular body; said endless screw including a generally conical shaft and a helicoidal blade mounted to said shaft; and a rear excess fluid outlet provided in said proximate end of said tubular body.

Other advantages and features of the present invention will become more apparent upon reading of the following non restrictive description of preferred embodiments thereof, given by way of example only with reference to the accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
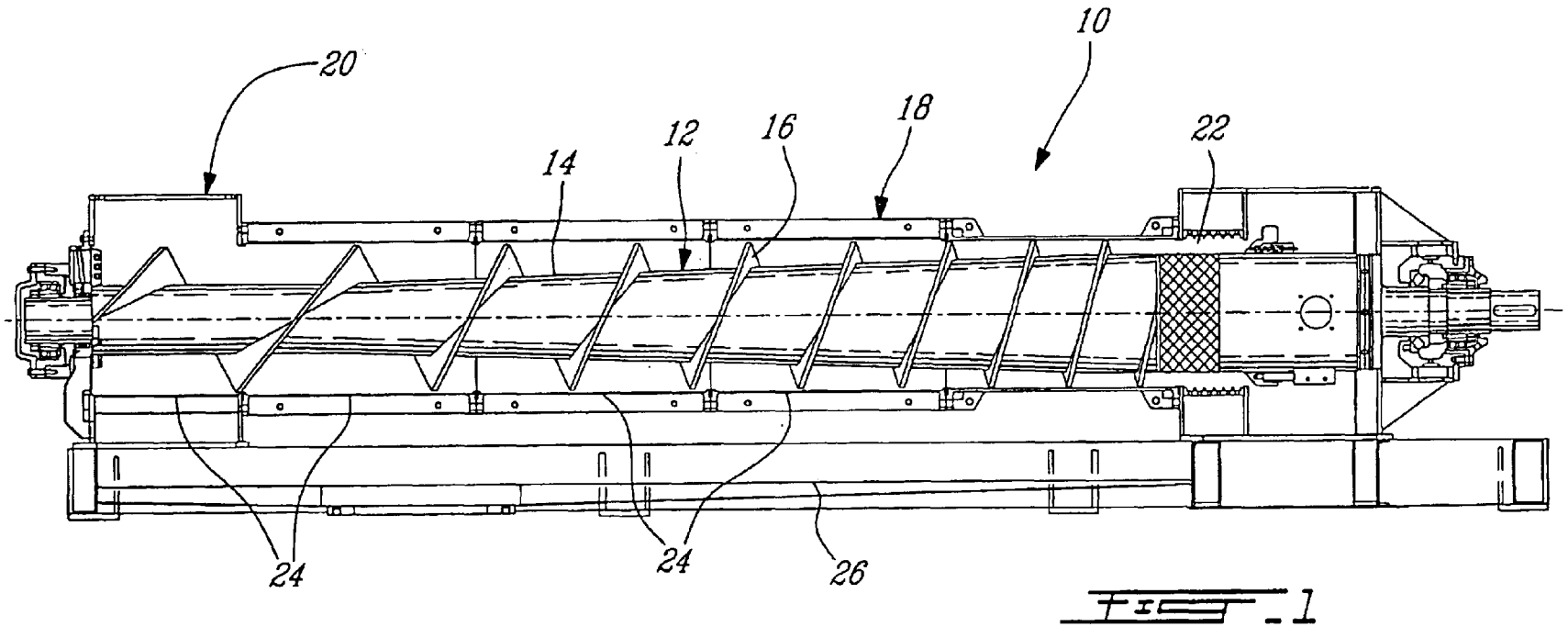
FIG. 1 is a side elevational sectional view of a screw press according to an embodiment of the present invention.

Turning now to FIG. 1 of the appended drawings, a screw press 10 according to an embodiment of the present invention will be described.

As discussed hereinabove, the principle of operation of screw presses is believed well known to those skilled in the art and will not be further discussed in details herein. Furthermore, for concision purposes, various elements and portions of the screw press 10 that do not have a direct impact on the present invention will not be described herein.

The screw press 10 includes an endless screw 12, provided with a conical shaft 14 and an helicoidal blade 16, and a generally tubular body 18 having a material inlet 20 near a first longitudinal end and a material outlet 22 near a second longitudinal end thereof. The tubular body 18 is provided with meshed elements 24 defining a meshed surface allowing excess fluid to egress therefrom and to be collected in a fluid receiving receptacle 26.

Figure 2:
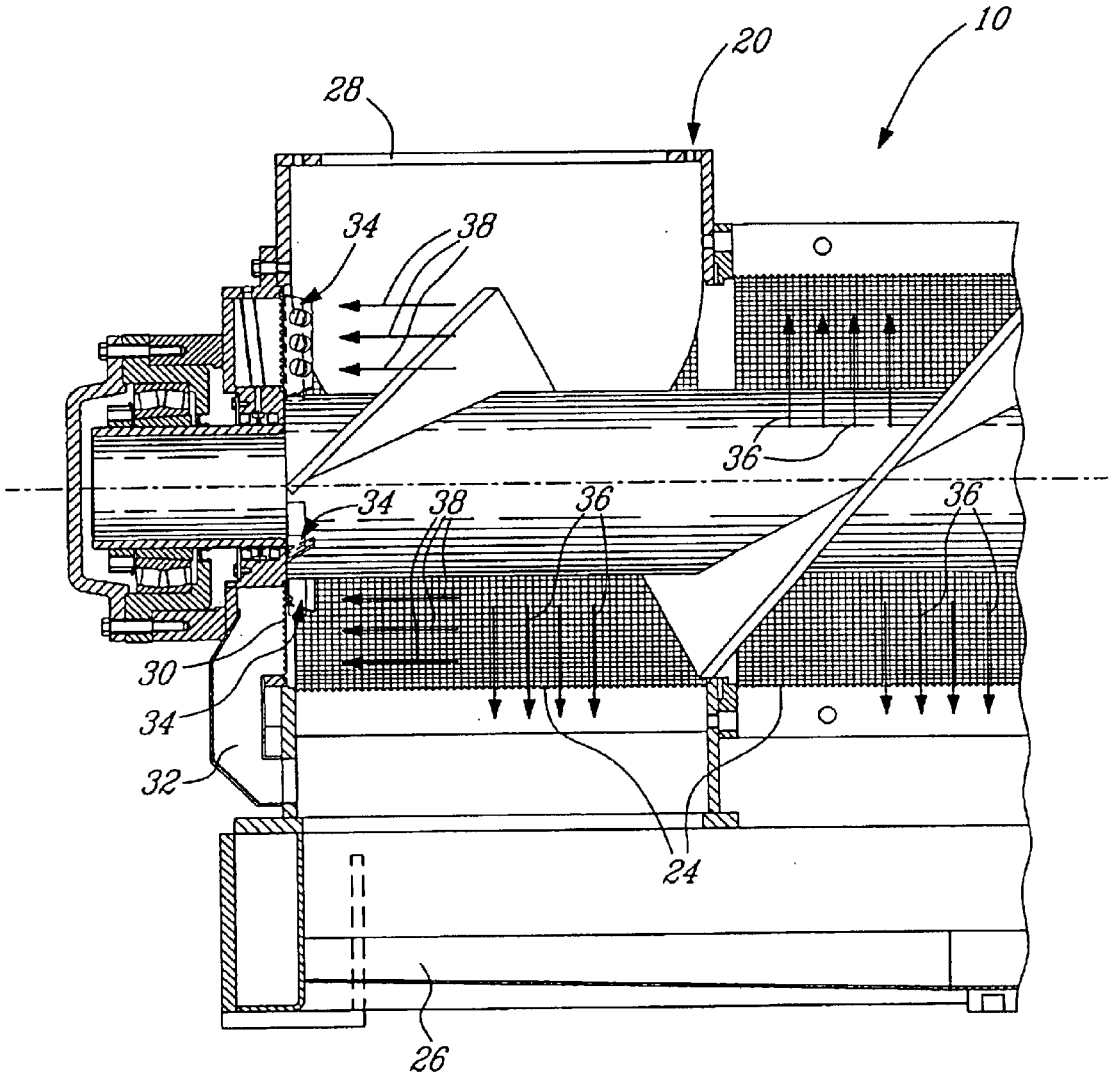
FIG. 2 is an enlarged sectional view of the inlet end of the screw press of FIG. 1.

As can be better seen from FIG. 2 of the appended drawings, the material inlet 20 includes a raw material inlet 28, a rear toroidal screen 30 defining a rear excess fluid outlet, a fluid expelling conduit 32 and three scraper blades assemblies 34. It is to be noted that the number of scraper blades is not critical and could vary according to the surface of the rear excess fluid outlet.

As will be readily understood by one skilled in the art, the raw material that enters the screw press 10 through the raw material inlet 28 is formed of solid matter mixed with excess fluid. It is at the material inlet 20 that the proportion of solid material to excess fluid is the lowest. It is therefore at the material inlet that a great portion of the excess fluid will egress the screw press 10 (see arrows 36) through the meshed elements 24. The added rear toroidal screen 30 allows excess water to egress faster from the material inlet 20 of the screw press 10 (see arrows 38) since the meshed surface is increased near the material inlet 20, thereby increasing the available top rotational speed of the endless screw 12.

Indeed, it has been found that the limitation of the top rotational speed of the endless screw 12 is mainly due to the inefficiency of conventional screw presses to allow the excess fluid to egress the material inlet 20 thereof quickly enough. By increasing the screened surface in the material inlet 20, it is possible to significantly increase the flow of excess fluid out of the material inlet to thereby increase the available top rotational speed of the endless screw 12.

The fluid conduit 32 allows the egressing fluid to flow in the fluid receptacle 26.

As will be apparent to one skilled in the art, it is advantageous to prevent solid matter from clogging the screened surfaces of the body 18 since it would decrease the efficiency of fluid removal.

Figure 3:
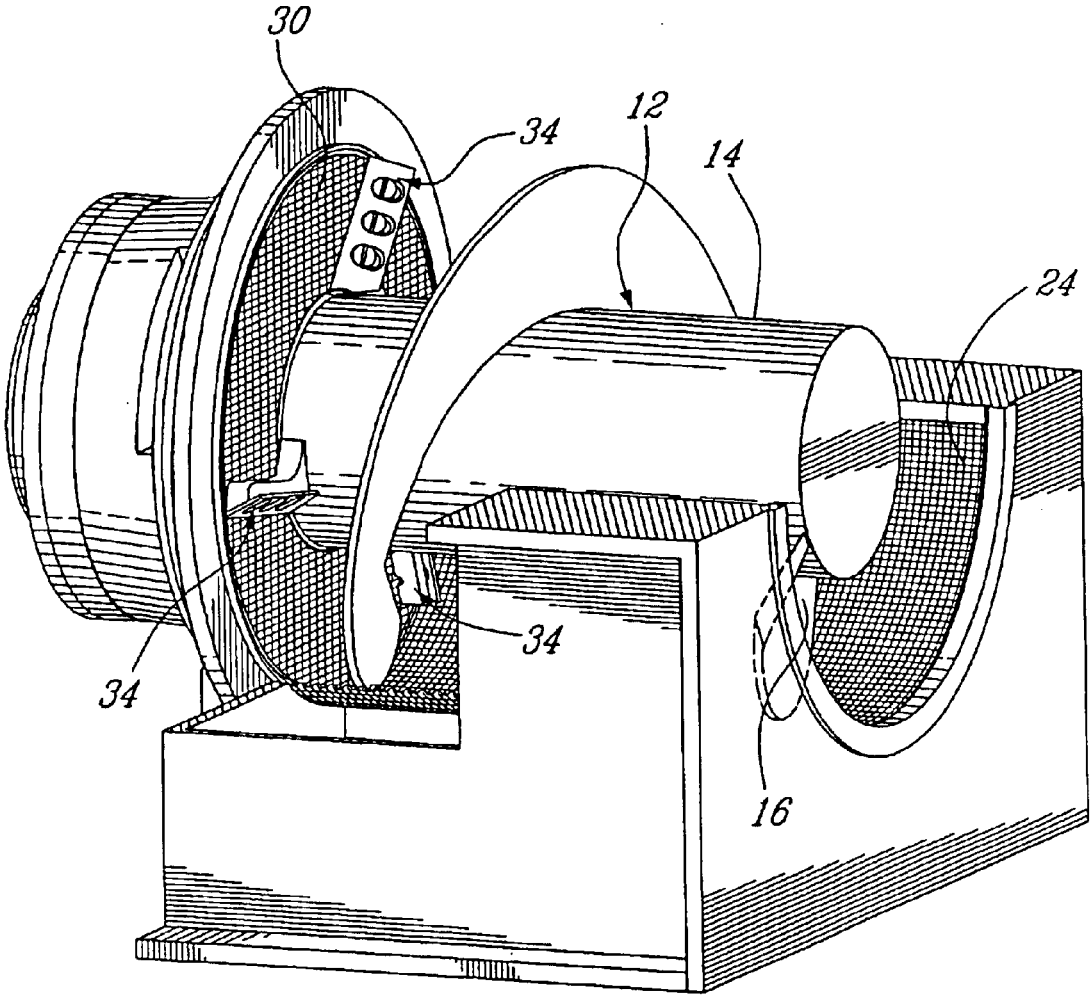
FIG. 3 is a perspective view, partly sectional, of a portion of the inlet end of FIG. 2.

The scraper blades assemblies 34, which may be better seen from FIG. 3 of the appended drawings, are so mounted to the end of the endless screw 12 as to contact the rear toroidal screen 30 in such a manner that the rotation of the endless screw 12 induces a scraping action against the screen 30. Of course, this contact is not necessary since a near-contact is generally sufficient to prevent the clogging of the toroidal screen 30. Clogging of the circular screen 30 is therefore prevented by the scraper blade assemblies 34.

Figure 4:
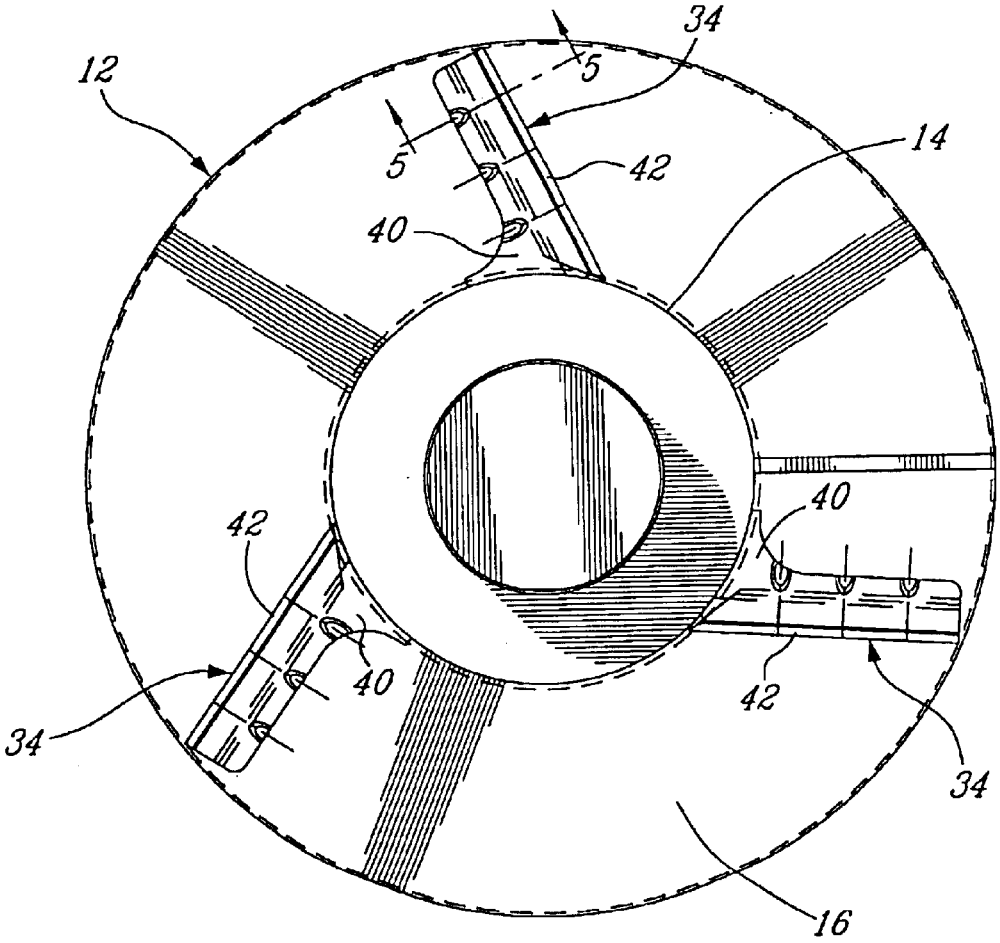
FIG. 4 is an end view of the endless screw of the screw press of FIG. 1.
Figure 5:
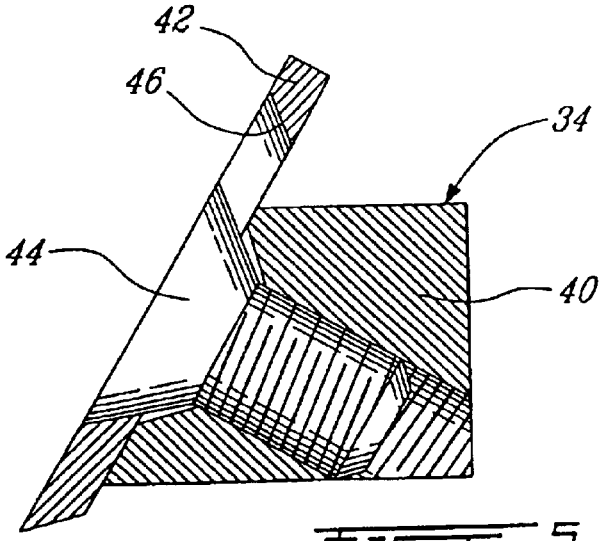
FIG. 5 is a sectional view taken along line 5—5 of FIG. 4.

Turning now more specifically to FIGS. 4 and 5 of the appended drawings, the scraper blade assemblies 34 will be described in greater detail.

As can be seen from FIG. 4, each scraper blade assembly 34 includes a support 40 mounted to the endless screw 12 and a movable scraper blade 42 mounted to a corresponding support 40.

FIG. 5 illustrates a sectional portion of one of the scraper blade assemblies 34. As can be seen from this figure, the movable scraper blade 42 is mounted to the support 40 via three machine screw fasteners 44 (only one shown in FIG. 5) that are inserted in oblong apertures 46 of the scraper blade 42. The oblong shape of the apertures 46 thereby allow the adjustment of the scraper blade 42 to ensure an adequate cleaning of the rear toroidal screen 30.

Although the present invention has been described hereinabove by way of preferred embodiments thereof, it can be modified, without departing from the spirit and nature of the subject invention as defined in the appended claims.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A generally horizontal screw press for removing excess fluid from material; comprising:

a generally tubular body having a meshed surface; said body having a material inlet provided near a proximate end thereof;

an endless screw mounted in said tubular body; said endless screw including a generally conical shaft and a helicoidal blade mounted to said shaft;

a rear excess fluid outlet provided in said proximate end of said tubular body, said rear excess fluid outlet including a toroidal screen; and a proximate end of said endless screw including at least one blade assembly that is so mounted thereto as to be in near-contact with said toroidal screen;

whereby rotation of said endless screw induces a cleaning action of said at least one blade assembly against said toroidal screen to thereby prevent said screen from becoming clogged.

2. A screw press as recited in claim 1, wherein said rear excess fluid outlet includes a meshed surface to allow the excess fluid to egress the screw press.

3. A screw press as recited in claim 1, wherein said rear excess fluid outlet is toroidal.

4. A screw press as recited in claim 1, wherein said at least one blade assembly includes a support mounted to the endless screw and a blade movably mounted to said support.

5. A screw press as recited in claim 1, wherein said at least one blade assembly includes three ape blade assemblies.

* * * * *

UNITED STATES PATENT AND TRADEMARK OFFICE

CERTIFICATE OF CORRECTION

PATENT NO. : 6,925,929 B2
DATED : August 9, 2005
INVENTOR(S) : Dionne

It is certified that error appears in the above-identified patent and that said Letters Patent is hereby corrected as shown below:

Column 4,
Line 32, replace "one blade assembly includes three ape blade assemblies." with
-- one blade assembly includes three blade assemblies. --.

Signed and Sealed this

Twenty-third Day of May, 2006

JON W. DUDAS
*Director of the United States Patent and Trademark Office*